United States Patent [19]

Mount et al.

[11] Patent Number: 4,538,422

[45] Date of Patent: Sep. 3, 1985

[54] METHOD AND CONTROL SYSTEM FOR LIMITING COMPRESSOR CAPACITY IN A REFRIGERATION SYSTEM UPON A RECYCLE START

[75] Inventors: Gordon L. Mount, W. Monroe; William J. Lavigne, Jr., Fayetteville, both of N.Y.

[73] Assignee: Carrier Corporation, Syracuse, N.Y.

[21] Appl. No.: 610,057

[22] Filed: May 14, 1984

[51] Int. Cl.[3] ..... F25D 17/02

[52] U.S. Cl. ..... 62/201; 62/217; 62/228.5

[58] Field of Search ..... 62/201, 180, 185, 158, 62/157, 231, 217, 196.2, 228.5, 228.4, 228.3, 228.1; 236/1 EA; 417/12, 290

[56] References Cited

U.S. PATENT DOCUMENTS

| | | | |
|---|---|---|---|
| 3,890,798 | 6/1975 | Fujimoto et al. | 62/155 |
| 4,152,902 | 5/1979 | Lush | 62/157 |
| 4,267,704 | 5/1981 | Yapp | 62/158 |
| 4,270,361 | 6/1981 | LaBarge | 62/158 |
| 4,282,718 | 8/1981 | Kountz et al. | 62/201 |
| 4,381,650 | 5/1983 | Mount | 62/157 |
| 4,399,663 | 8/1983 | Hesler | 62/193 |
| 4,404,811 | 9/1983 | Mount et al. | 62/84 |

*Primary Examiner*—Harry Tanner

*Attorney, Agent, or Firm*—Douglas L. Miller

[57] ABSTRACT

A method and control system are disclosed for minimizing the number of recycle starts of a compressor in a refrigeration system to thereby reduce wear and tear on the mechanical and electrical systems of the refrigeration system thereby prolonging the operating life and improving the reliability of the refrigeration system. The rate at which the refrigeration system compressor's capacity is increased upon the recycle start is greatly reduced compared to a normal, relatively fast rate of increase which is provided when the capacity of the compressor is controlled directly in response to the load placed on the refrigeration system. This prevents the refrigeration system from quickly satisfying a new, increased load placed on the refrigeration system upon a recycle start which will then require a relatively quick shutdown of the refrigeration system compressor due to excess cooling capacity and require a relatively quick subsequent recycle start of the compressor. In this manner, the number of recycle starts is minimized.

7 Claims, 2 Drawing Figures

METHOD AND CONTROL SYSTEM FOR LIMITING COMPRESSOR CAPACITY IN A REFRIGERATION SYSTEM UPON A RECYCLE START

BACKGROUND OF THE INVENTION

The present invention relates to methods of operating and control systems for refrigeration systems and, more particularly, to methods of operating and control systems for controlling recycle starts of a compressor in a refrigeration system.

Generally, refrigeration systems include an evaporator or cooler, a compressor, and a condenser. Usually, a heat transfer fluid is circulated through tubing in the evaporator thereby forming a heat transfer coil in the evaporator to transfer heat from the heat transfer fluid flowing through the tubing to refrigerant in the evaporator. The heat transfer fluid chilled in the tubing in the evaporator is normally water which is circulated to a remote location to satisfy a refrigeration load. The refrigerant in the evaporator evaporates as it absorbs heat from the water flowing through the tubing in the evaporator, and the compressor operates to extract this refrigerant vapor from the evaporator, to compress this refrigerant vapor, and to discharge the compressed vapor to the condenser. In the condenser, the refrigerant vapor is condensed and delivered back to the evaporator where the refrigeration cycle begins again.

To maximize operating efficiency, it is desirable to match the amount of work done by the compressor to the work needed to satisfy the refrigeration load placed on the refrigeration system. Commonly, this is done by capacity control means which adjusts the amount of refrigerant vapor flowing through the compressor. The capacity control means may be a device such as guide vanes which are positioned between the compressor and the evaporator and which move between a fully open and a fully closed position in response to the temperature of the chilled water leaving the chilled water coil in the evaporator. When the evaporator chilled water temperature falls, indicating a reduction in refrigeration load on the refrigeration system, the guide vanes move toward their closed position, decreasing the amount of refrigerant vapor flowing through the compressor. This decreases the amount of work that must be done by the compressor thereby decreasing the amount of energy needed to operate the refrigeration system. At the same time, this has the effect of increasing the temperature of the chilled water leaving the evaporator. In contrast, when the temperature of the leaving chilled water rises, indicating an increase in load on the refrigeration system, the guide vanes move toward their fully open position. This increases the amount of vapor flowing through the compressor and the compressor does more work thereby decreasing the temperature of the chilled water leaving the evaporator and allowing the refrigeration system to respond to the increased refrigeration load. In this manner, the compressor operates to maintain the temperature of the chilled water leaving the evaporator at, or within a certain range of, a set point temperature. Under certain operating conditions, such as low load conditions, the refrigeration system may provide excess capacity for satisfying the load placed on the refrigeration system even though the guide vanes are at their fully closed position which corresponds to a minimum operating capacity for the compressor. Under these conditions, it is customary to turn off the refrigeration system compressor to prevent undesirable excess cooling of the water flowing through the heat transfer tubes in the evaporator which, if unchecked, could result in freezing of this water. Then, when a new, increased load on the refrigeration system is detected, the compressor is restarted and the guide vanes are again used to adjust refrigeration system capacity to match the load placed on the refrigeration system. A restart of the refrigeration system compressor under the foregoing conditions is known as a recycle start. Recycle starts are not particularly desirable since they produce wear and tear on the mechanical and electrical systems of the refrigeration system and may reduce the operating life and decrease the reliability of the overall refrigeration system.

SUMMARY OF THE INVENTION

Therefore, it is an object of the present invention to prolong the operating life of a refrigeration system and to improve the reliability of the refrigeration system by reducing the number of recycle starts made by the refrigeration system.

This and other objects of the present invention are attained by a method of operating and control system for a refrigeration system which greatly reduces the rate at which compressor capacity is increased upon a recycle start. This is accomplished according to the present invention with a programmable electronic control system, such as a microcomputer control system, by programming in a very gradual capacity increase into the control logic for the refrigeration system compressor, which is followed only during a recycle start. When starting the refrigeration system compressor for other reasons, such as daily operation, safety trip, etc., a faster, normal rate of increase in compressor capacity is used.

BRIEF DESCRIPTION OF THE DRAWINGS

Still other objects and advantages of the present invention will be apparent from the following detailed description of the present invention in conjunction with the accompanying drawings in which.

DESCRIPTION OF THE PREFERRED EMBODIMENT

Figure 1:
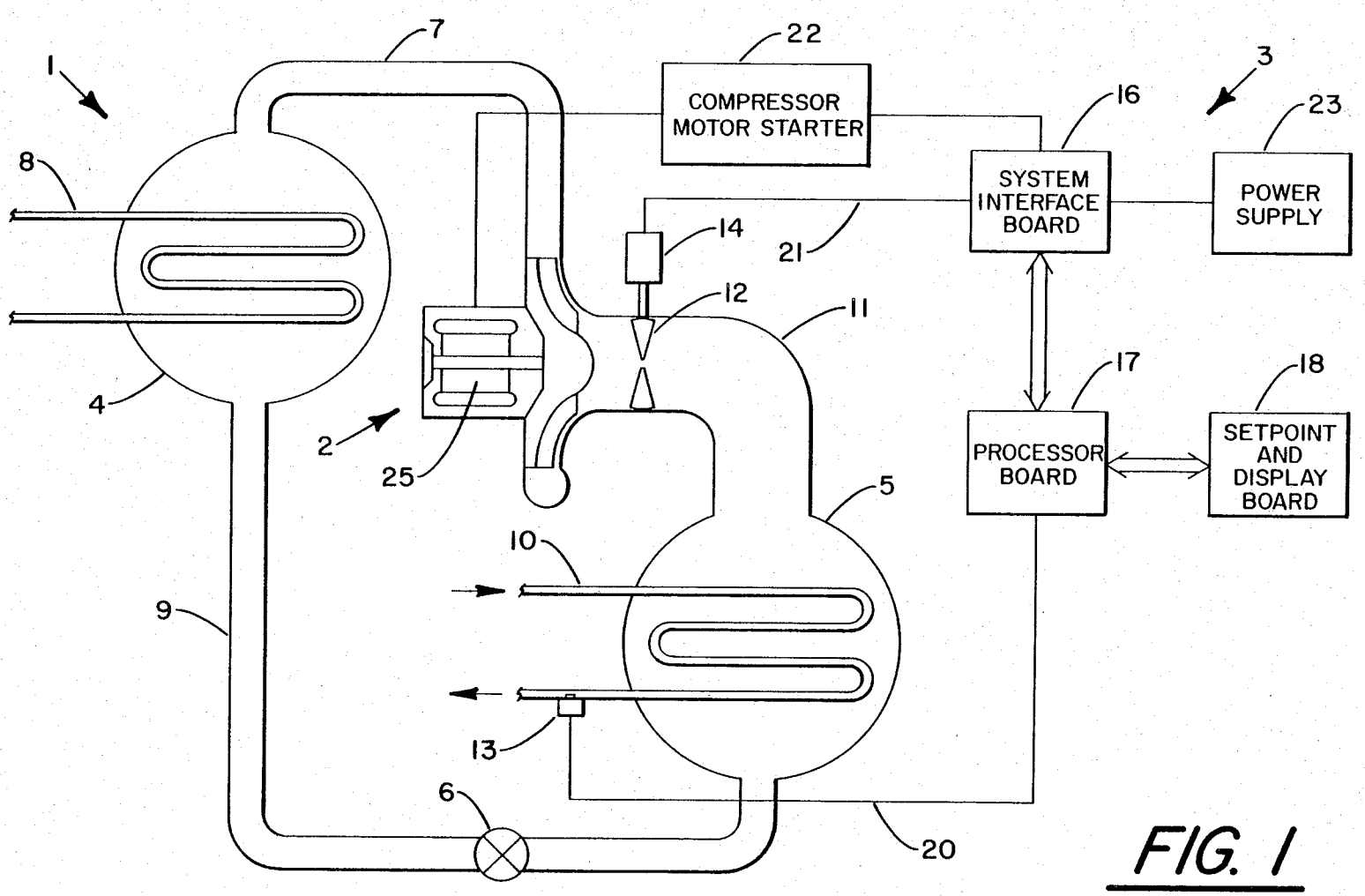
FIG. 1 is a schematic illustration of a centrifugal vapor compression refrigeration system with a control system for operating the refrigeration system according to the principles of the present invention.

Referring to FIG. 1, a centrifugal vapor compression refrigeration system 1 is shown having a control system 3 for operating the refrigeration system 1 according to the principles of the present invention. As shown in FIG. 1, the refrigeration system 1 includes a compressor 2, a condenser 4, an evaporator 5, and an expansion device 6. In operation, compressed gaseous refrigerant is discharged from the compressor 2 through compressor discharge line 7 to the condenser 4 wherein the gaseous refrigerant is condensed by relatively cool condensing water flowing through tubing 8 in the condenser 4. The condensed liquid refrigerant from the condenser 4 passes through refrigerant line 9 and expansion device 6 to the evaporator 5. The liquid refrigerant in the evaporator 5 is evaporated to cool a heat transfer fluid, such as water, flowing through tubing 10 in the evaporator 5. This cool heat transfer fluid is used to cool a building or is used for other such purposes. The gaseous refrigerant from the evaporator 5 flows through compressor suction line 11 back to the compressor 2 under the control of compressor inlet guide vanes 12. The gaseous refrigerant entering the compressor 2 through the guide vanes 12 is compressed by the compressor 2 and discharged from the compressor 2 through the compressor discharge line 7 to complete the refrigeration cycle. This refrigeration cycle is continuously repeated during normal operation of the refrigeration system 1.

Also, as shown in FIG. 1, the centrifugal compressor 2 of the refrigeration system 1 includes an electric motor 25 for driving the compressor 2 which is under the control of the control system 3. Also, it may be seen that the compressor inlet guide vanes 12 are opened and closed by a guide vane actuator 14 controlled by the control system 3.

The control system 3 includes a compressor motor starter 22, a power supply 23, a system interface board 16, a processor board 17, and a set point and display board 18. Also, a temperature sensor 13 for sensing the temperature of the heat transfer fluid leaving the evaporator 5 through the tubing 10, is connected by electrical lines 20 directly to the processor board 17.

Preferably, the temperature sensor 13 is a temperature responsive resistance device such as a thermistor having its sensing portion located in the heat transfer fluid leaving the evaporator 5 with its resistance monitored by the processor board 17. Of course, as will be readily apparent to one of ordinary skill in the art to which the present invention pertains, the temperature sensor 13 may be any of a variety of temperature sensors suitable for generating a signal indicative of the temperature of the heat transfer fluid leaving the evaporator 5 and for supplying this generated signal to the processor board 17.

The processor board 17 may be any device or combination of devices, for receiving a plurality of input signals, for processing the received input signals according to preprogrammed procedures, and for producing desired output control signals in response to the received and processed input signals, in a manner according to the principles of the present invention. For example, the processor board 17 may comprise a microcomputer, such as a model 8031 microcomputer available from Intel Corporation which has a place of business at Santa Clara, Calif.

Further, preferably, the set point and display board 18 comprises a visual display, including, for example, light emitting diodes (LED's) or liquid crystal display (LCD's) devices forming a multi-digit display which is under the control of the processor board 17. Also, preferably, the set point and display board 18 includes a device, such as a set point potentiometer model AW5403 available from CTS, Inc. which has a place of business at Skyland, N.C., which is adjustable to output a signal to the processor board 17 indicative of a selected set point temperature for the heat transfer fluid leaving the evaporator 5 through the tubing 10.

The system interface board 16 includes a plurality of switching devices for controlling the flow of electrical power from the power supply 23 through the system interface board 16 to the guide vane actuator 14 and the motor 25 for driving the compressor 2. Each of the switching devices may be a model SC-140 triac available from General Electric Company which has a place of business at Auburn, N.Y. However, as will be readily apparent to one of ordinary skill in the art to which the present invention pertains, switches other than triac switches may be used as the switching devices.

The switching devices on the system interface board 16 are controlled in response to control signals received by the switching devices from the processor board 17. In this manner, the guide vane actuator 14 and the motor 25 driving the compressor 2 are controlled by the processor board 17.

The guide vane actuator 14 may be any device suitable for driving the guide vanes 12 toward either their fully open or fully closed position in response to electrical power signals received via electrical lines 21. For example, the guide vane actuator 14 may be an electric motor, such as a model MC-351 motor available from the Barber-Coleman Company having a place of business in Rockford, Ill., for driving the guide vanes 12 toward either their fully open or fully closed position depending on which one of two switching devices on the system interface board 16 is actuated in response to control signals received by the switching devices from the processor board 17. The guide vane actuator 14 may be controlled to drive the guide vanes 14 toward their fully open or fully closed position according to any one of a variety of control schemes designed to control the capacity of the refrigeration system 1 to match the load placed on the refrigeration system 1.

The compressor motor starter 22 is a device for supplying electrical power from the power supply 23 to the electric motor 25 of the compressor 2 to start up and run the motor 25. For example, the compressor motor starter 22 may be a conventional wye-delta (Y-Δ) contactor type motor starter. Of course, as will be readily apparent to one of ordinary skill in the art to which the present invention pertains, the compressor motor starter 22 may be any one of a variety of systems for supplying electrical power from the power supply 23 to the electric motor 25 of the compressor 2 to start and run the motor 25.

In operation, the temperature sensor 13 senses the temperature of the heat transfer fluid in tubing 10 leaving the evaporator 5 and a signal indicative of this sensed temperature is supplied to the processor board 17 of the control system 3. Also, a signal indicative of a set point temperature is supplied from the set point and display board 18 to the processor board 17. This set point temperature is an operator selected temperature to which the heat transfer fluid leaving the evaporator 5 through the tubing 10 is to be cooled by operation of the refrigeration system 1. Thus, the temperature sensed by the temperature sensor 13 relative to the set point temperature setting of the set point and display board 18 represents a refrigeration load to be satisfied by operation of the refrigeration system 1.

The processor board 17 is programmed to compare the temperature sensed by the temperature sensor 13 to the selected set point temperature setting of the set point and display board 18. If the sensed temperature sensed by the temperature sensor 13 exceeds the set point temperature setting of the set point and display board 18 by a predetermined amount, the processor board 17 generates control signals to turn on the refrigeration system 1. As part of turning on the refrigeration system 1, the processor board 17 supplies electrical control signals to the system interface board 16 to close certain switching devices on the system interface board 16. This results in electrical power flow from the power supply 23 through the system interface board 16 to the compressor motor starter 22 which starts and runs the electric motor 25 of the compressor 2 in the refrigeration system 1. Also, electrical power flows from the power supply 23 through the system interface board 16 and the electrical lines 21 to the guide vane actuator 14 under control of the processor board 17 so that the guide vanes 12 may be controlled by the processor board 17 to match the load placed on the refrigeration system 1. Thus, in the foregoing manner, the processor board 17 turns on the refrigeration system 1, including the refrigeration system compressor 2, when the processor board 17 detects a load to be satisfied by operation of the refrigeration system 1.

After the refrigeration system 1 is turned on by the processor board 17, the refrigeration system 1 continuously operates to satisfy the refrigeration load. The processor board 17 adjusts the capacity of the refrigeration system 1 to match the load by controlling the guide vane actuator 14 to move the compressor inlet guide vanes 12 between their fully open and fully closed positions in response to detected changes in the load on the refrigeration system 1. However, if the processor board 17 determines that the load has been satisfied and that the refrigeration system 1 is providing excess cooling capacity for satisfying the load even though the guide vanes 12 are positioned at their fully closed position corresponding to the minimum operating capacity for the compressor 2, the processor board 17 generates a control signal to open the appropriate switching device on the system interface board 16 to discontinue the power flow from the power supply 23 through the compressor motor starter 22 to the electric motor 25 of the compressor 2 of the refrigeration system 1. This effectively turns off the refrigeration system compressor 2 while otherwise maintaining the refrigeration system 1 ready for operation.

According to the present invention, when the compressor 2 is turned off by the processor board 17 due to excess cooling capacity, this information is stored in the memory of the processor board 17. Then, when it is desired to again turn on the refrigeration system compressor 2 to operate the refrigeration system 1 to satisfy a new, increased load on the refrigeration system 1, the processor board 17 controls the capacity of the refrigeration system 1 in a special way to reduce the likelihood that another recycle start will be required in the near future. Specifically, upon a recycle start, the processor board 17, through control of the switching devices on the system interface board 16, controls the guide vane actuator 14 to greatly reduce the rate of opening of the guide vanes 12 by the actuator 14 compared to the normal, relatively fast rate at which the guide vanes 12 are opened to directly match the detected load placed on the refrigeration system 1. This relatively slow rate of opening of the guide vanes 12 is maintained until the capacity of the refrigeration system compressor 2 is increased to a level necessary to just meet the detected load on the refrigeration system 1. Then, control of the guide vanes 12 by the processor board 17 is carried out directly in response to the detected load requirements on the refrigeration system 1. By increasing the capacity of the refrigeration system 1 at this relatively slow rate upon a recycle start in the foregoing manner, the refrigeration system 1 is prevented from quickly satisfying the new, increased load placed on the refrigeration system 1 after which the refrigeration system compressor 2 will again have to be turned off thereby necessitating another recycle start of the compressor 2. Thus, fewer recycle starts are made thereby reducing wear and tear on the mechanical and electrical systems of the refrigeration system 1 to prolong the operating life and to improve the reliability of the refrigeration system 1.

Figure 2:
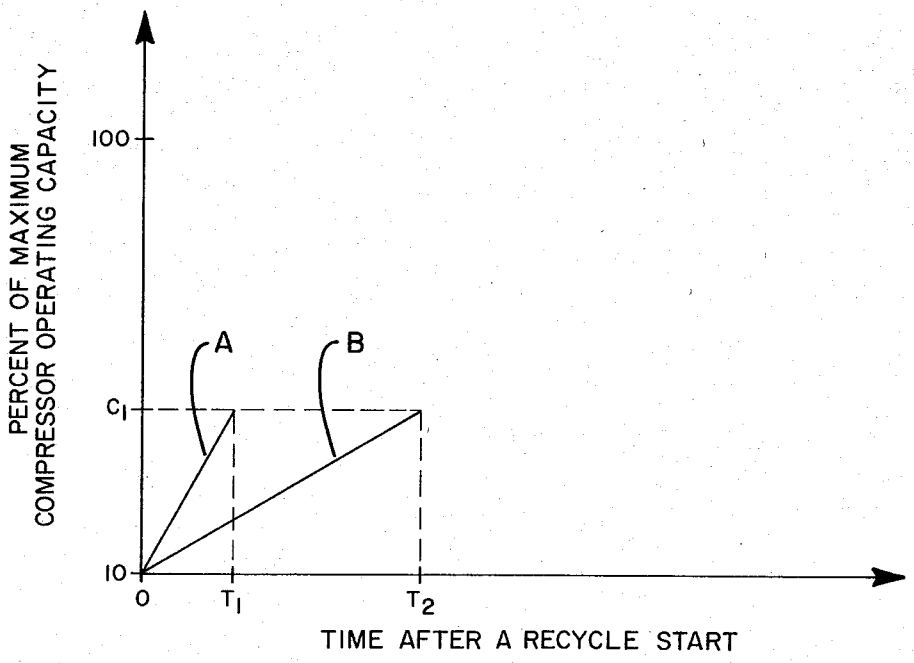
FIG. 2 is a graph illustrating the principles of operation of the control system shown in FIG. 1.

The foregoing described operation according to the principles of the present invention is best understood by referring to FIG. 2 which is a purely illustrative graph showing percent of maximum compressor operating capacity as determined by the position of the guide vanes 12 as a function of time after a recycle start of the compressor 2. The curve labeled "A" represents a typical, normal, relatively fast rate of increase in the capacity of the compressor 2 as a function of time after a recycle start when the capacity of the compressor 2 is controlled by the processor board 17 directly in response to the load placed on the refrigeration system. The curve labeled "B" represents a special, relatively slow rate of increase in the capacity of the compressor 2 as a function of time after a recycle start when the capacity of the compressor 2 is controlled by the processor board 17 according to the principles of the present invention.

As shown in FIG. 2, if the rate of increase in the capacity of the compressor 2 follows the curve labeled "A" then the capacity of the compressor 2 relatively quickly reaches, at time $T_1$, a desired capacity level designated $C_1$ which matches the detected load placed on the refrigeration system 1. However, also as shown in FIG. 2, if the rate of increase in capacity of the compressor 2 follows the curve labeled "B" then the capacity of the compressor 2 is much more slowly increased to the desired capacity level $C_1$ in a time period $T_2$ which is a significantly longer time period than the time period $T_1$ necessary to reach the desired capacity level $C_1$ when following the curve labeled "A". As discussed previously, according to the present invention, by following the curve labeled "B", the capacity of the compressor 2 is prevented from relatively quickly reaching the desired capacity level $C_1$. This prevents the refrigeration system 1 from quickly satisfying the detected load placed on the refrigeration system 1 upon a recycle start which will cause the system compressor 2 to be again turned off due to excess capacity thereby subsequently requiring another relatively quick recycle start in response to a new increase in the load placed on the refrigeration system 1. Thus, according to the present invention, the number of recycle starts of the refrigeration system 1 is reduced relative to the number of recycle starts which would be typically necessary if the refrigeration system 1 was controlled directly in response to the load placed on the refrigeration system 1 as is done conventionally.

Referring to FIG. 2, it should be noted that the curves "A" and "B" shown in this Figure are not representative of actual rates of compressor capacity increase which may be used in an actual refrigeration system 1. These curves "A" and "B" are provided only for purposes of facilitating understanding of the principles of the present invention. As will be readily apparent to one of ordinary skill in the art to which the present invention pertains, actual operating curves followed by a real compressor 2 in an actual refrigeration system 1 may have any one of a variety of forms including a form which is not a straight line. Also, in this regard, it should be noted that in FIG. 2, a minimum capacity of 10% of the maximum compressor operating capacity is shown for the guide vanes 12 in their fully closed position. However, this percentage has been arbitrarily selected and the actual minimum capacity for a compressor 2 in a refrigeration system 1 may vary from this arbitrary value. Further, it should be noted that, preferably, according to the present invention, the capacity of the compressor 2 is controlled by the processor board 17 directly in response to the load placed on the refrigeration system 1 after the capacity of the compressor 2 reaches the desired capacity level $C_1$ by following the curve labeled "B" as shown in FIG. 2. In this manner, upon a recycle start, after the capacity of the compressor 2 has undergone a relatively slow rate of increase according to the principles of the present invention then normal control of the capacity of the compressor 2 is resumed so that the refrigeration system 1 directly responds to changes in the load placed on the refrigeration system 1.

Of course, the foregoing description is directed to a particular embodiment of the present invention and various modifications and other embodiments of the present invention will be readily apparent to one of ordinary skill in the art to which the present invention pertains. Therefore, while the present invention has been described in conjunction with a particular embodiment, it is to be understood that various modifications and other embodiments of the present invention may be made without departing from the scope of the invention as described herein and as claimed in the appended claims.

What is claimed is:

1. In a method of operating a vapor compression refrigeration system including a compressor which is part of the refrigeration system, including the steps of:

monitoring a load to be satisfied by operation of the refrigeration system;

turning on the refrigeration system, including the refrigeration system compressor, when the step of monitoring detects a load to be satisfied by operation of the refrigeration system;

adjusting the capacity of the refrigeration system to match the load on the refrigeration system when the refrigeration system is turned on to satisfy the load detected by the step of monitoring;

turning off the refrigeration system compressor when, to match a low load, the refrigeration system is adjusted to its minimum capacity level by the step of adjusting and the refrigeration system is providing excess capacity for satisfying this low load even through the refrigeration system is operating at its minimum capacity level;

a recycle start method for greatly reducing the rate of increase in the capacity of the compressor upon a recycle start, comprising the steps of:

turning the refrigeration system compressor back on when the step of monitoring detects a new and relatively small increased load to be satisfied by operation of the refrigeration system after the refrigeration system compressor has been turned off due to excess capacity;

increasing the capacity of the refrigeration system from its minimum capacity level toward its maximum capacity level at a preselected, relatively slow rate which is less than the rate required immediately to match the load on the refrigeration system; and repeating the step of adjusting when the capacity of the refrigeration system is increased by the step of increasing to a level which matches the new, relatively small increased load on the refrigeration system.

2. A method of operating a refrigeration system as recited in claim 1 wherein the step of monitoring comprises:

sensing the temperature of a heat transfer fluid which is cooled by operation of the refrigeration system.

3. A method of operating a vapor compression refrigeration system as recited in claim 1 wherein the step of adjusting comprises:

moving guide vanes between a fully closed position and a fully open position to control flow of refrigerant vapor to the compressor of the refrigeration system.

4. In a control system for a vapor compression refrigeration system including a compressor which is part of the refrigeration system, comprising:

sensor means for monitoring a load to be satisfied by operation of the refrigeration system and for providing a signal indicative of the magnitude of the montiored load;

switch means for turning the refrigeration system, including the refrigeration system compressor, on and off in response to control signals received by said switch means;

capacity control means for controlling the capacity of the refrigeration system in response to control signals received by said capacity control means; and control means for receiving and for processing the signal provided by the sensor means and for generating and providing control signals to the switch means and to the capacity control means to turn on the refrigeration system, including the refrigeration system compressor, when the sensor means detects a load to be satisfied by operation of the refrigeration system, to adjust the capacity of the refrigeration system to match the load on the refrigeration system when the refrigeration system is turned on, to turn off the refrigeration system compressor when, to match a low load, the refrigeration system is adjusted to its minimum capacity level by the capacity control means and the refrigeration system is still providing excess capacity for satisfying this low load even through the refrigeration system is operating at its minimum capacity level.

the improvement comprising a recycle start means for the control means for greatly reducing the rate of increase in the capacity of the compressor upon a recycle start, the recycle start means being able to turn the refrigeration system compressor back on when a new, relatively small increased load is detected by the sensor means and, when the refrigeration system is turned back on in response to the new, relatively small increased load, to increase the capacity of the refrigeration system, at a preselected, relatively slow rate which is less than the rate required to immediately match the load on the refrigeration system, from the minimum capacity level of the compressor to a level which approximately matches the new load on the refrigeration system.

5. A control system for a vapor compression refrigeration system as recited in claim 4 wherein the sensor means comprises:

means for sensing the temperature of a heat transfer fluid which is cooled by operation of the refrigeration system.

6. A control system for a refrigeration system as recited in claim 4 wherein the capacity control means comprises:

guide vanes which are opened and closed to control flow of refrigerant vapor to the compressor of the refrigeration system.

7. A control system for a refrigeration system as recited in claim 4 wherein the control means comprises:

a microcomputer control system.

* * * * *